US005675982A

United States Patent [19]

Kirol et al.

[11] Patent Number: 5,675,982

[45] Date of Patent: Oct. 14, 1997

[54] PULSED OPERATION CONTROL VALVE

[75] Inventors: Lance D. Kirol; James W. Langeliers; Travis Chandler, all of Boulder City, Nev.

[73] Assignee: Rocky Research, Boulder City, Nev.

[21] Appl. No.: 638,301

[22] Filed: Apr. 26, 1996

[51] Int. Cl.[6] ..... F25B 41/04

[52] U.S. Cl. ..... 62/225; 137/624.14; 236/92 B

[58] Field of Search ..... 236/92 B; 62/225; 137/624.14; 251/118, 123

[56] References Cited

U.S. PATENT DOCUMENTS

| | | | |
|---|---|---|---|
| Re. 23,706 | 9/1953 | Lange | 236/92 B |
| 2,100,494 | 11/1937 | Sparks | 236/92 B |
| 2,335,824 | 11/1943 | Dillman | 236/92 B |
| 2,579,034 | 12/1951 | Dube et al. | 236/92 B |
| 2,669,849 | 2/1954 | Lange | 236/92 B |
| 3,698,416 | 10/1972 | Kwok | 137/624.14 |
| 4,534,914 | 8/1985 | Takahashi et al. | 137/624.14 |
| 4,750,334 | 6/1988 | Leimbach | 236/92 B |
| 4,900,189 | 2/1990 | Barosso et al. | 137/624.14 |
| 5,415,008 | 5/1995 | Bessler | 62/212 |
| 5,463,876 | 11/1995 | Bessler et al. | 62/223 |

*Primary Examiner*—William E. Tapolcai
*Attorney, Agent, or Firm*—Jerry R. Seiler, Esq.

[57] ABSTRACT

A valve assembly includes a refrigerant inlet port and a refrigerant outlet port having a restricted opening, with the inlet port opening at least 2 times larger than the restricted outlet port opening. The valve includes components for opening and closing the inlet port in response to valve cavity pressure between the inlet and outlet ports.

The larger inlet port relative to the restricted outlet port provides for rapid pressure buildup in the valve cavity when the inlet port is open which, in turn, causes rapid closing of the inlet port. The valve is capable of rapid cycling rates, highly effective for small refrigeration or cooling apparatus, as well as for controlling pressure in other applications requiring pressure regulation.

67 Claims, 1 Drawing Sheet

PULSED OPERATION CONTROL VALVE

BACKGROUND OF THE INVENTION

An essential part of most refrigeration systems is an expansion device that controls flow of liquid refrigerant into the evaporator, and reduces the pressure of the refrigerant from the condenser pressure to evaporator pressure. Expansion devices typically used include thermostatic expansion valves, pulse-width modulated solenoid valves, and passive devices such as capillary tubes or orifices. Small-capacity refrigeration systems, such as household refrigerators, typically use a capillary tube, which can be sized to provide optimum refrigerant flow at only one operating condition. Thus, at conditions other than the design point, a capillary tube results in the evaporator being starved of refrigerant at high-load conditions, and flooded at low-load conditions. Both evaporator starving and flooding reduce efficiency of the refrigeration system.

As is known in the art, an active expansion device that maintains the proper amount of refrigerant in the evaporator at all load conditions can result in increased efficiency. However, active expansion devices such as thermostatic expansion valves do not work well on small refrigeration systems because they cannot be made with orifices small enough to regulate low flow rates. Such orifices are impractical to manufacture and are very susceptible to plugging. Accordingly, there is a need for a thermostatic expansion valve that can control low refrigerant flow rates without the need for small orifices.

SUMMARY OF THE INVENTION

The control valve of the present invention provides accurate refrigerant flow control at flow rates as low as several grams per hour without the need for small orifices. This valve can also be used for pressure or flow control of small flow rates in applications other than refrigerant expansion. The control valve of the present invention is especially suitable for small vapor compressor refrigeration systems, as well as refrigerant sorption cooling appliances, for example, in refrigerator/freezer appliances having small capacities below about 200 watts and especially those of about 10–100 watt cooling capacity. According to the invention, a thermostatic expansion valve (TXV) suitable for small refrigeration systems includes a liquid refrigerant inlet port and an outlet port having a flow restriction between the valve and the evaporator. The restricted outlet port has a flow area less than the flow area of the inlet port. The valve includes a cavity having a limited volume between the valve inlet and outlet ports which volume is less than the volume of the system evaporator. The valve also includes means responsive to pressure within the valve cavity for opening and closing the inlet port. The size of the larger inlet port flow relative to the restricted outlet port provides for rapid pressure rise in the valve cavity when the inlet port is opened. The outlet restriction allows the pressure within the cavity to remain above evaporator pressure long enough to cause the valve to quickly close the open inlet port. In a preferred embodiment, a bulb or other device is used to sense evaporator superheat and provide pressure to the valve for opening and closing the inlet port. A diaphragm exposed to the bulb pressure controls opening and closing of the inlet port depending on the balance of forces on opposite sides of the diaphragm. In another embodiment, bulb charges of ammonia with propylene glycol, ethylene glycol or water are particularly useful for ammonia refrigerant cooling systems, while dimethyl ether with propylene glycol or ethylene glycol is useful for fluorocarbon refrigerant cooling systems for operating a diaphragm-controlled thermostatic expansion valve of the invention.

DETAILED DESCRIPTION OF THE PREFERRED EMBODIMENTS

Figure 1:
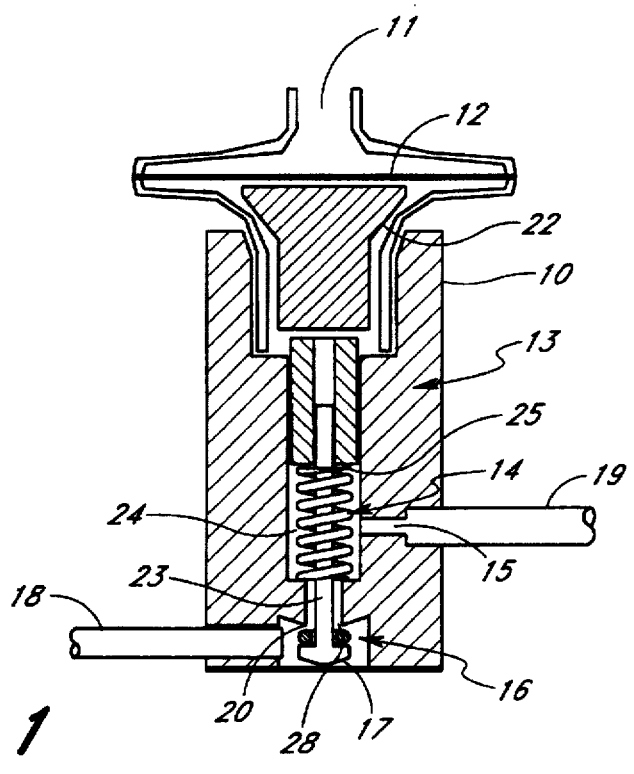
FIG. 1 is a sectional view of an evaporator control valve of the invention.

The thermostatic expansion valve (TXV) of the present invention is especially useful for refrigeration systems, heat pumps, refrigerators and/or freezers of relatively small capacity. The valve has an inlet port for liquid refrigerant, an outlet port and a valve cavity between the inlet and outlet ports. Pressure drop is created by a restriction in or associated with the outlet port. The valve includes means for opening and closing the inlet port which is responsive to pressure within the valve cavity, with higher pressure tending to close the inlet port and lower pressure tending to open it. Specific means including examples of components and features for opening and closing the valve in response to pressure in the cavity are shown in the drawings and will be discussed hereinafter. An important feature and function of the valve is the capability of rapid pressure buildup in the valve cavity followed by rapid closing of the inlet port. Such a function is achieved by an inlet flow area sufficiently large relative to the size of the outlet flow area providing for rapid pressure buildup in the cavity, and in response to the high pressure, causing the inlet port to be quickly closed after each opening. Effective and preferred inlet and outlet flow areas will be disclosed hereinafter. The valve is further characterized by an interior cavity volume that is less than the volume of the evaporator to which it supplies refrigerant.

FIG. 1 illustrates a thermostatic expansion valve especially suitable for small capacity sorption or vapor-compression refrigerators or cooling apparatus. The valve shown comprises a valve body 10 having an interior cavity 24. Valve seat 20 defines valve port 28 which is opened and closed as seal 16, seated against valve plug 17, is moved upwardly and downwardly in response to the movement of diaphragm 12 against bar 22 and plunger 13 which are urged toward the diaphragm by spring 14. The assembly includes bulb connection port or pressure port 11, inlet pipe 18 and outlet pipe 19. The diaphragm is urged against the upper surface of bar 22 by pressure from a bulb, not shown, via the bulb connection port 11. Inlet pipe 18 communicates with a condenser or a liquid refrigerant reservoir (not shown), and outlet pipe 19 communicates with the evaporator of the refrigeration system. A restriction or restricted port 15 is located between the interior valve cavity 24 and outlet pipe 19. A valve stem or rod 23 connects the piston to valve plug 17, and spring 14 urges the piston upwardly toward the diaphragm to close the inlet port. Pressure from a bulb on the bulb side of the diaphragm via pressure port 11 urges the diaphragm against bar 22 and piston 13 to compress spring 14 and force seal 16 downwardly to open valve inlet port 28. Pressure in the cavity also pushes against valve plug 17 for opening valve port 28. Forces tending to close the valve are: pressure against the evaporator (bottom) side of the diaphragm 12, i.e., the pressure in the valve cavity, the force of spring 14, and condenser pressure on the valve plug 17 via inlet pipe 18. When the sum of the forces tending to open the valve exceeds the sum of the forces tending to close the valve, the valve opens. Otherwise, the valve is designed to remain closed. Alternatively, the valve may be designed such that the condenser pressure tends to open the valve. However, the valve design of the example shown in the drawing utilizes condenser pressure for closing the valve for relatively high condenser pressures such as encountered where ammonia refrigerant is used.

The valve controls refrigerant flow to the evaporator by cycling open and closed, rather than continuously modulating flow rate. In order for the valve to operate properly according to the invention, the inlet orifice 20 must be large enough to allow the pressure inside the valve cavity to quickly rise above bulb pressure and close the valve. On startup, the bulb is essentially at ambient temperature and the pressure in the bulb is close to the condenser pressure. The inlet orifice must be sufficiently large to fill the valve cavity to near condenser pressure while refrigerant is also flowing through the outlet. Thus, as a minimum, the inlet orifice must provide less pressure drop than that of the outlet.

An important distinguishing feature of the thermostatic expansion valve of the invention is the flow restriction between the valve and the system evaporator and the small volume of valve interior between the inlet port valve seat and the restriction. Observing FIG. 1, flow restriction 15 is located between the valve cavity 24 and the evaporator to which outlet pipe 19 communicates for directing condensed refrigerant. The specific location of restriction 15 is not critical, so long as it is downstream of the valve cavity 24. The restriction 15 as well as its location between the valve cavity or valve interior and the evaporator ensures that the evaporator side of diaphragm 12 is exposed to pressures equal to or higher than evaporator inlet pressures. Thus, when the pressure on the bulb side of diaphragm 12 increases, or evaporator pressure decreases to the balance point, the valve opens and pressure builds under the diaphragm, i.e., within the valve, causing the valve to quickly reclose. Pressure decays as fluid bleeds through restriction 15 to the evaporator until pressure within the valve body and valve cavity 24 and on the evaporator side of diaphragm 12 drops sufficiently to allow the valve to reopen. With the valve open, a small mass of liquid refrigerant is introduced into the valve cavity through the open inlet port, the valve then quickly recloses, and additional liquid refrigerant is not introduced until the previous "quantum" of refrigerant has bled to the evaporator. This valve operation may be referred to as a pulse operation, rather than modulation, offering improved control on refrigeration systems having small refrigerant flow rates.

Due to the relative sizes of the inlet and outlet ports, pressure buildup in the valve cavity will occur rapidly and result in the inlet port closing within about ½ second, or less, from the time the inlet port is opened. The pressure buildup and inlet port closing may occur more rapidly, and the valve is capable of cycle rates of up to 60 times per second. However, if desired, the cycle rate may be driven by demand, for example, as low as one cycle per hour.

The minimum size of the outlet restriction may be calculated to provide for flow of refrigerant vapor at the maximum design flow rate with a pressure drop equal to the maximum acceptable increase in bulb pressure at the maximum acceptable flow rate and yet not too small to be practical. The valve inlet port must have a flow area larger than the area of the outlet restriction. Regardless of the size or area of the outlet restriction, the valve seat flow resistance should be less than the evaporator flow resistance, with resistances based on liquid flow. In use the flow across the valve seat is mostly liquid, with two-phase flow in the evaporator. Thus while the valve is open, the mass rate into the valve will be much greater than the mass rate leaving the valve, and pressure in the cavity will rise and closure will occur quickly.

The effective volume of the valve cavity between the inlet port and the outlet port restriction is less than the evaporator volume. The volume of the valve cavity 24 between valve seat 20 and restriction 15 should be large enough so that the valve does not attempt to cycle faster than its natural frequency at refrigeration capacity, and small enough so that it does not contain enough liquid to flood the evaporator. Valve components within the valve cavity will reduce its effective volume. The size or cross-sectional area of restriction 15 should be large enough so that plugging of the restriction is not a problem, and yet small enough to allow refrigerant to bleed therethrough to the evaporator, as previously described. Further consideration of valve inlet and outlet port size are related to temperature response time of the evaporator-bulb system. A preferred ratio of the area of the opening of the restriction 15:effective area of inlet orifice 28 is at least about 1:2, preferably 1:4, more preferably above 1:20, and most preferably between about 1:10–1:20. Thus, the preferred cross-sectional or effective inlet flow area of the valve inlet port 28 is at least 2 or more times the area of opening of the outlet port or restriction 15, and more preferably 10–20 times to ensure that pressure quickly builds under the diaphragm whereby the valve rapidly recloses. It will be understood that the effective inlet area of the inlet port is diminished by any components taking up space at or along the inlet area through which refrigerant must flow. Thus, for example, the area or space occupied by rod 23, or any other component at the inlet or outlet ports or along any critical refrigerant flow area, must be factored into the calculations of the aforesaid ratios.

Figure 2:
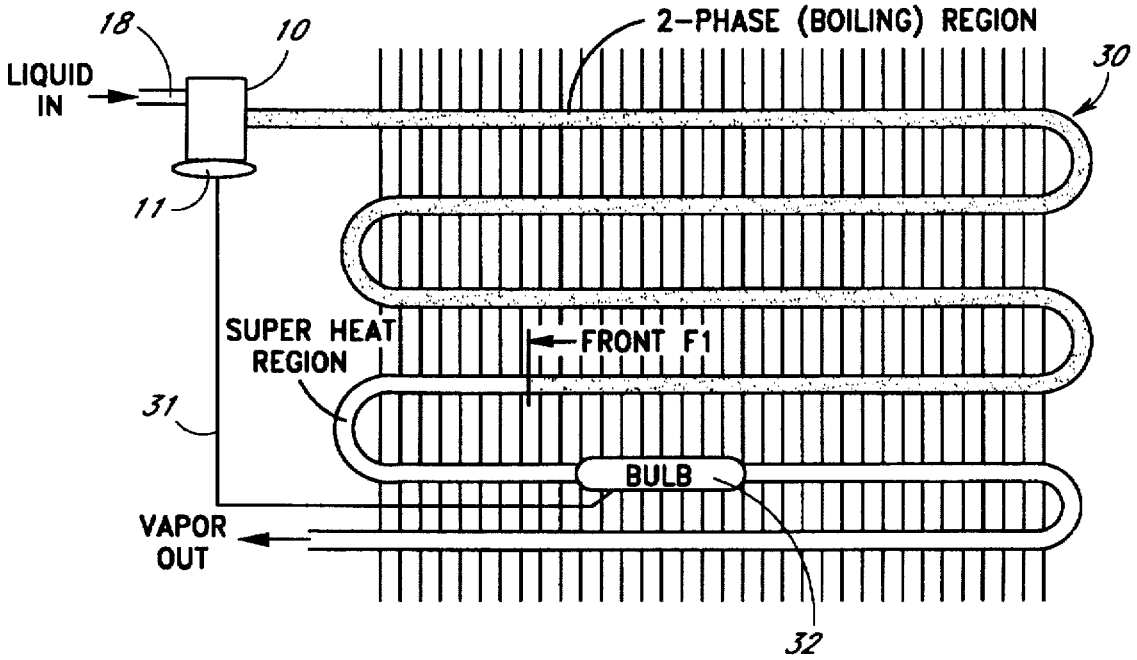
FIG. 2 schematically illustrates an evaporator and a valve of the invention for controlling evaporator superheat.

FIG. 2 illustrates an evaporator 30 in which a bulb 32 is located on the superheat region of the evaporator tube. The bulb is in contact with valve 10 via pressure conduit 31 which exposes the valve diaphragm 12 (FIG. 1) to bulb pressure at pressure port 11. As shown, refrigerant boiling occurs through most of the evaporator, referred to as the 2-phase (boiling) region, and with a relatively short section of evaporator tube providing heat transfer to superheat the refrigerant vapor in the superheat region. The response time for a bulb pressure and temperature to respond to increased refrigerant flow will depend on the bulb charge, the refrigerant, valve component dimensions, etc. There is also a response time from the instant the valve closes for decay of pressure inside the valve cavity as refrigerant flows to the evaporator through the outlet restriction until the valve opens again. As soon as the valve closes cavity pressure will begin to decay, and depending on bulb temperature and pressure, the valve inlet may open again when cavity pressure is above evaporator pressure. In the limit however, the bulb will be at nearly the exact temperature for the desired superheat, and the cavity pressure will decay to nearly evaporator pressure, and the valve will not open unless there is rise in bulb temperature and pressure. In normal operation, the front where boiling stops and superheat starts (F1) will slowly recede away from the bulb and toward the evaporator inlet. As the boiling front moves back, the vapor will become more and more superheated before it reaches the bulb. Eventually the bulb pressure will rise sufficiently to open the valve, the boiling front will move closer to the bulb, and bulb temperature and pressure will drop. After each valve opening, the valve will again close as soon as cavity pressure increases significantly above evaporator pressure. After the valve cavity pressure decays the valve will open again unless the bulb has cooled below the set superheat. Normally the evaporator-bulb pressure response from the time refrigerant begins to flow to the evaporator will be slow compared to the valve cavity pressure decay response time, and the valve will open more than once before the bulb has cooled to (or below) the desired superheat. Thus, the pressure decay response time in the valve cavity is less than the time it takes to increase the bulb pressure following addition of refrigerant to the evaporator. Preferably, the valve pressure decay response time is less than ⅓ of the bulb pressure response time. To prevent flooding, however, multiple openings of the valve should not admit sufficient refrigerant to fill all the evaporator including the superheat section in front of the bulb, (and the superheat section behind the bulb if such a section exits). The valve cavity may not completely fill on each valve opening, but the valve should be designed so that evaporator flooding will not occur if the cavity does completely fill. For this purpose, the effective volume of the valve cavity is preferably less than about 30% of the volume of the superheat region of the evaporator.

To reduce startup problems with a warm evaporator the bulb charge must be selected properly. If the bulb is charged with the same refrigerant as the system refrigerant, the superheat pressure is set by the spring pressure tending to close the valve plus net force exerted on the valve plug by condenser pressure. If superheat pressure is set to give some reasonable superheat at normal operating evaporator temperature, the same pressure difference will equate to much lower superheat temperature when the evaporator is at ambient temperature and pressure. Low superheat temperature for startup conditions means that excessive flooding occurs until the evaporator is cooled significantly. For most vapor compression systems, this results in a loss of efficiency but does not impose operation problems. However, small capacity sorption refrigeration systems, especially periodic systems, may not ever be able to cool the evaporator because it warms back up during the desorption cycle. One traditional solution is to charge the bulb only with vapor to some fixed pressure. With a vapor charge, the valve will control the evaporator to a fixed pressure until the bulb is cooled sufficiently for condensation to occur, and below the condensing temperature the valve will act as a true TXV. However, with a limited bulb charge any condensing at colder point in the bulb circuit, such as at the diaphragm, will prevent condensing in the bulb and the bulb temperature will not control the valve. The bulb must be the coldest point in the circuit, or there must be sufficient bulb charge to fill the diaphragm cavity and capillary tube and still retain liquid in the bulb. Condensing at the diaphragm can be avoided by placing the valve in a relatively warm location, but this adds parasitic cooling losses which reduce efficiency and can significantly reduce available cooling capacity on small systems.

The aforesaid valve control problems can be overcome by using a bulb charge with different vapor pressure and slope of the vapor pressure vs. temperature line than is used as the system refrigerant. This is known as a cross charge. Pure substances for cross charges which give the desired valve response to different evaporator temperatures often don't exist or are not suitable due to toxicity, hazard, or cost. Sorbent charges or mixtures are used as an alternative to cross charging with pure substances. Sorbent charges comprising a mixture of the same refrigerant used in the evaporator and a vapor pressure suppressant often work well. However, to provide rapid absorption of gas into the bulb charge solution, it is useful to have polar substances. Substances able to hydrogen bond are especially desirable for the same reason.

A preferred bulb charge will give relatively constant superheat over all expected evaporator temperatures. For example, if ammonia is used as the bulb charge in an ammonia refrigerant system, setting a spring force for 10° C. at −35° C. typically results in only 1° or 2° C. superheat at +20° C. evaporator, making startup with a warm bulb difficult. However, using a mixture of ammonia and a suitable lower vapor pressure substance, such as water or propylene glycol, gives nearly constant superheat at any evaporator pressure and requires much less spring force.

Bulb sorbent charges especially useful with ammonia refrigerant include ammonia-water mixtures, ammonia-alcohol mixtures, and ammonia glycol mixtures. Ammonia in amounts of between about 5% and about 70%, by weight, are preferred. Ethers, glycol ethers, polyethers, amides, polyamides, ester, and polyesters also are suitable absorbents for ammonia and can be used as one component of the bulb charge. Mixtures using the lower glycols (ethylene glycol, propylene glycol) with 10%–50% ammonia, by weight, are especially useful because (1) neither component can freeze at expected evaporator temperatures if separation occurs, (2) the sorbents are polar and capable of hydrogen bonding, thus exhibiting a strong tendency to absorb ammonia, (3) they are inexpensive and have low or no toxicity, (4) they are not corrosive, and (5) the concentration of the mixture can be set to give the desired temperature response and superheat. Dimethyl ether with propylene glycol and/or ethylene glycol in mixtures of between about 40% and 95% dimethyl ether are also especially useful for ammonia refrigerant.

Most fluorocarbon refrigerants are not polar and are not capable of hydrogen bonding. Thus, when the refrigerant is a fluorocarbon and a sorbent bulb charge is desired, the bulb charge should be selected by using a polar gas with vapor pressure close to that of the system refrigerant, and adding a polar absorbent to suppress vapor pressure thereby avoiding problems of condensing at the diaphragm, etc. For example, when R134a (tretrafluoroethane) is used as the refrigerant suitable bulb charges include the aforesaid water-ammonia mixtures containing between about 5% and 85% ammonia and dimethyl ether-propylene glycol or ethylene glycol mixtures, especially containing between about 40% and 95% dimethyl ether, by weight. Ammonia-propylene glycol and/or ethylene glycol mixtures containing between about 10% and 70% ammonia are also especially useful with tetrafluoroethane.

Useful gas-sorbent mixtures for the bulb charge when the system refrigerant is not ideal for a constituent of the bulb charge because it is not polar include gases selected from dimethyl ether, lower ethers ($C_1$–$C_6$), lower aliphatic tertiary amines ($C_1$–$C_6$), and lower aliphatic ketones ($C_1$–$C_6$), and absorbents selected from propylene glycol, ethylene glycol, alcohols, glycol ethers, polyethers, esters, polyesters, di-, tri-, and polyalcohols, di-, tri-, and polyamines, amides, polyamides and water. Ammonia, methyl amine, and other lower amines ($C_1$–$C_6$) are used with absorbents selected from alcohols, glycols, di-, tri-, and poly-alcohols, ethers, glycol ethers, polyethers, amides, polyamides, esters, polyesters, and water.

Once a bulb charge is selected, it is desirable to determine a maximum acceptable increase in superheat at maximum refrigerant flow, and convert this superheat increase to bulb pressure. For example, with an ammonia evaporator operating at −35° C. and 10° C. design superheat, and a mixture of 66 mass percent ammonia and 34% ethylene glycol in the bulb, with 1° C. acceptable increase in superheat at maximum flow, relevant pressures are:

Evaporator pressure=13.5 psia at −35° C.

Bulb pressure=14.4 psia @−25° C. (10° C. SH)

Bulb pressure=15.1 psia @−24° C. (11° C. SH)

The valve outlet restriction is sized to provide 0.7 psi pressure drop at the maximum refrigerant flow.

As a specific example, a valve having the following component dimensions was used on a small ammonia sorption refrigeration system operated at 15–25 watts at −32° C. evaporator and 50°–60° C. condenser temperatures:

Outlet restriction diameter: 0.054 cm (0.021 in.)

Inlet port diameter: 0.20 cm (0.08 in.)

Internal valve volume (valve cavity): 1 cc (0.06 cu. in.)

System evaporator volume: ~15 cc

The previously described thermostatic expansion valve of the invention may be used to control superheat when a refrigerant is used on the bulb side, and as a pressure regulator to control evaporator pressures by placing fixed gas pressure or spring force on the bulb side of the diaphragm. The effect of condenser pressure on control pressure may be canceled by placing a gas charge on the bulb side in thermal contact with the condenser. By selecting the proper ratio of diaphragm area and valve port area, the effect of condenser pressure on the force balance can be totally canceled over the normal operating range.

The valve of the invention may be used in any refrigerator/freezer or other cooling apparatus in which control of liquid refrigerant to an evaporator is required. The valve is especially suitable for relatively small capacity systems having refrigerant flows of less than 12 kg/hr. Moreover, the use of such a valve becomes even more beneficial for systems having refrigerant lows of less than 6 kg/hr and especially where refrigerant flows are less than 3 kg/hr. Where refrigerant flows are even less, for example, between about 5 and about 75 grams/hr, as may be found in ammonia refrigerant systems as previously described, the valve of the invention is uniquely beneficial. Stated as a function of cooling capacity, such refrigeration systems are typically those of less than 1,000 watts, particularly less than 500 watts, more particularly less than 250 watts and most particularly less than 100 watts. Very small capacity ammonia cooling or refrigeration systems in which the valve effectively and most beneficially operates are in the 10–100 watt capacity range.

The valve may be used for any refrigerant system including those using the fluorocarbon refrigerants CFC, HFC and HCFC, non-polar refrigerants such as propane or butane as well as the polar refrigerants such as disclosed in U.S. Pat. Nos. 5,441,995 and 5,477,706, the descriptions of which are incorporated herein by reference. The valve is effective for vapor compression systems using a mechanical compressor, as well as small-capacity thermal compressor sorption refrigeration apparatus as described in U.S. application Ser. No. 08/390,678 and incorporated herein by reference. Such apparatus have one or more sorbers containing a solid sorption composition capable of alternately adsorbing and desorbing a gaseous refrigerant. The solid sorbent may be any composition including the well-known inclusion compounds such as a zeolite, activated alumina, activated carbon, and silica gel or a metal hydride. Preferred sorbents are the complex compounds formed by adsorbing a polar gaseous refrigerant on a metal salt as disclosed in U.S. Pat. No. 4,848,994 and incorporated herein by reference. Particularly preferred are the complex compounds formed by a process in which the density is optimized by restricting the volumetric expansion of the complex compound as disclosed in U.S. Pat. No. 5,298,231 and 5,328,671, the descriptions of which are incorporated herein by reference. Such complex compounds are capable of reaction rates substantially increased as compared to the reaction rates of complex compounds formed without such volumetric expansion restriction and density control. Such sorbents include the metal salts and complex compounds as well as mixtures thereof with the aforesaid inclusion compounds. The most preferred complex compounds are those in which ammonia is the refrigerant.

Although the valve of the invention has been described primarily for refrigeration applications, it is also useful as a pressure control valve for applications other than refrigeration. As a pressure regulator, the valve is most useful where small flow rates are involved and modulating pressure regulators do not control well. The pressure bias used against pressure in the valve cavity can be provided by mechanical means such as spring pressure or by fluid pressure (liquid or gas).

We claim:

1. A valve assembly for pulsed operation between open and closed conditions comprising:

one inlet port for being open and closed during operation having an inlet flow area and a valve for opening and closing said inlet port, an open outlet port having an outlet flow area, a valve cavity between said inlet port and said outlet port and in open communication therewith, said valve being responsive to pressure within said valve cavity for opening and closing said inlet port, and wherein higher pressure therein biases said valve to close said inlet port and lower pressure therein biases said valve to open said inlet port, said inlet flow area being larger than said outlet flow area whereby opening said inlet port provides for rapid pressure buildup in said cavity and rapid closure thereof after each opening, whereby said valve is pulsed to rapidly open and close said inlet port during said operation.

2. The valve assembly of claim 1 wherein said valve is capable of closing said inlet port within at least ½ second after said inlet port opens.

3. The valve assembly of claim 2 wherein said valve is capable of opening and closing said inlet port 60 times per second.

4. The valve assembly of claim 1 including a pressure port communicating with an external bias pressure for urging said valve to open said inlet port.

5. The valve assembly of claim 4 including a bellows or diaphragm cooperating with said pressure port.

6. The valve assembly of claim 1 including biasing means for urging said valve to close said inlet port.

7. The valve assembly of claim 1 wherein said inlet port includes a valve seat, and wherein said valve includes a valve plug for sealing said valve seat.

8. The valve assembly of claim 6 wherein said inlet port includes a valve seat, and wherein said valve includes a valve plug for sealing said valve seat.

9. The valve assembly of claim 6 wherein said biasing means includes a spring for urging said valve to close said inlet port.

10. The valve assembly of claim 1 wherein said inlet flow area is at least 2 times larger than said outlet flow area.

11. The valve assembly of claim 1 wherein said inlet flow area is at least 10 times larger than said outlet flow area.

12. The valve assembly of claim 3 wherein said inlet flow area is at least 10 times larger than said outlet flow area.

13. The valve assembly of claim 2 wherein said inlet flow area is between about 10 and about 20 times the size of said outlet flow area.

14. A control assembly for controlling superheat of vapor in an evaporator comprising:

a valve assembly for pulsed operation between open and closed conditions including a liquid refrigerant inlet port and a valve for opening and closing said inlet port, an outlet port communicating with said evaporator, and a valve cavity therebetween, said valve being responsive to pressure within said valve cavity for opening and closing said inlet port, wherein higher pressure therein biases said valve to close said inlet port and lower pressure therein biases said valve to open said inlet port, said inlet flow area being at least twice the size of said outlet flow area whereby opening said inlet port provides for rapid pressure buildup in said cavity and rapid closure thereof after each opening, whereby said valve is pulsed to rapidly open and close said inlet port during said operation.

15. The control assembly of claim 14 wherein said inlet port has an area at least about 10 times larger than the area of said outlet port.

16. The control assembly of claim 14 wherein said inlet port has an area of between about 10 and about 20 times the area of said outlet port.

17. The control assembly of claim 14 including biasing means cooperating with said valve assembly for opening or closing said inlet port.

18. The control assembly of claim 14 wherein said valve is capable of closing said inlet port within at least ½ second after said inlet port opens.

19. The control assembly of claim 18 wherein said valve is capable of opening and closing said inlet port 60 times per second.

20. The control assembly of claim 17 wherein said biasing means comprises a pressure port on said valve assembly cooperating with a bulb in thermal contact with said evaporator for creating external pressure at said pressure port.

21. The control assembly of claim 20 wherein said valve assembly includes a diaphragm or bellows exposed to said pressure port and responsive to said external pressure for opening and closing said inlet port.

22. The control assembly of claim 21 wherein said valve assembly includes a valve plug for closing said inlet port and a spring cooperating therewith for biasing said valve plug to close said inlet port.

23. The control assembly of claim 22 wherein increased pressure at said pressure port urges said diaphragm or bellows to open said inlet port against the bias of said spring.

24. The control assembly of claim 14 including a movable member having a surface exposed to pressure in said valve cavity and cooperating with said valve for opening and closing said inlet port.

25. The control assembly of claim 14 wherein said valve cavity has a volume less than the volume of said evaporator.

26. The refrigeration apparatus of claim 14 wherein said valve cavity has a volume less than about 30% of the volume of the superheat region of said evaporator.

27. The control assembly of claim 25 wherein said biasing means comprises a pressure port on said valve assembly cooperating with a bulb in thermal contact with said evaporator for creating external pressure at said pressure port.

28. A method of operating the valve assembly of claim 14 comprising supplying liquid refrigerant from said valve assembly to said evaporator at the rate of less than 12 kg/hr and pulsing said inlet port between open and closed during said operation.

29. The method of claim 28 wherein the flow rate of said refrigerant from said valve assembly is less than 6 kg/hr.

30. The method of claim 28 wherein the flow rate of said refrigerant from said valve assembly is less than 3 kg/hr.

31. The method of claim 28 wherein the flow rate of said refrigerant from said valve assembly is between about 5 and about 75 grams/hr.

32. A refrigeration apparatus comprising a condenser for condensing refrigerant gas, an evaporator for cooling a load in thermal exposure therewith, and a valve assembly for pulsed operation between open and closed conditions for controlling refrigerant flow comprising:

an inlet port in communication with said condenser having an inlet flow area for receiving condensed refrigerant, and a valve for opening and closing said inlet port, an open outlet port having an outlet flow area and communicating with said evaporator for directing liquid refrigerant thereto, a valve cavity between said inlet port and said outlet port and in open communication therewith, said valve being responsive to pressure within said valve cavity for opening and closing said inlet port, and wherein higher pressure therein biases said valve to close said inlet port and lower pressure therein biases valve to open said inlet port, said inlet flow area being at least twice the size of said outlet flow area whereby opening said inlet port provides for rapid pressure buildup in said cavity and rapid closure thereof after each opening, whereby said valve is pulsed to rapidly open and close said inlet port during said operation.

33. The refrigeration apparatus of claim 32 including biasing means cooperating with said value assembly for opening or closing said inlet port.

34. The refrigeration apparatus of claim 33 wherein said biasing means comprises a pressure port on said valve assembly cooperating with a bulb in thermal contact with said evaporator for creating external pressure at said pressure port.

35. The refrigeration apparatus of claim 34 wherein said valve assembly includes a diaphragm or bellows exposed to said pressure port and responsive to said external pressure for opening and closing said inlet port.

36. The refrigeration apparatus of claim 34 wherein said bulb is in thermal contact with a superheat region of said evaporator for creating external pressure at said pressure port proportional to the vapor temperature in said evaporator.

37. The refrigeration apparatus of claim 36 wherein said valve assembly includes a diaphragm or bellows exposed to said pressure port and responsive to said external pressure for opening and closing said inlet port.

38. The refrigeration apparatus of claim 36 wherein said valve cavity has a volume less than about 30% of the volume of the superheat region of said evaporator.

39. The refrigeration apparatus of claim 32 including a thermal or mechanical compressor.

40. The refrigeration apparatus of claim 39 wherein said thermal compressor comprises a solid-gas sorption system.

41. The refrigeration apparatus of claim 40 wherein said solid-gas system comprises a complex compound, zeolite, activated carbon or metal hydride.

42. The refrigeration apparatus of claim 32 wherein the refrigerant is ammonia and the bulb charge is a mixture of ammonia and propylene glycol and/or ethylene glycol, wherein the mixture contains between about 10% and 50% ammonia, by weight.

43. The refrigeration apparatus of claim 32 wherein the refrigerant is ammonia and the bulb charge is a mixture of ammonia and water, wherein the mixture contains between about 5% and 70% ammonia, by weight.

44. The refrigeration apparatus of claim 32 wherein the refrigerant is ammonia and the bulb charge is a mixture of dimethyl ether and propylene glycol and/or ethylene glycol, wherein the mixture contains between about 40% and 95% dimethyl ether, by weight.

45. The refrigeration apparatus of claim 37 wherein the refrigerant is a fluorocarbon and the bulb charge is ammonia, propylene glycol, ethylene glycol, dimethyl ether, or water, or mixtures thereof.

46. The refrigeration apparatus of claim 45 wherein the fluorocarbon refrigerant is tetrafluoroethane and the bulb charge is a mixture of dimethyl ether and propylene glycol and/or ethylene glycol, wherein the mixture contains between about 40% and 95% dimethyl ether, by weight.

47. The refrigeration apparatus of claim 45 wherein the fluorocarbon refrigerant is tetrafluoroethane and the bulb charge is a mixture of water and ammonia, wherein the mixture contains between about 5% and 85% ammonia, by weight.

48. The refrigeration apparatus of claim 45 wherein the fluorocarbon refrigerant is tetrafluoroethane and the bulb charge is a mixture of ammonia and propylene glycol and/or ethylene glycol, wherein the mixture contains between about 10% and 70% ammonia, by weight.

49. The refrigeration apparatus of claim 32 wherein the refrigerant is ammonia and said bulb contains a mixture of ammonia and an absorbent selected from the group consisting of an alkylene glycol, alcohol, ether, glycol ether, polyether, amide, polyamide, ester, polyester, water and mixtures thereof.

50. The refrigeration apparatus of claim 32 wherein said refrigerant is a fluorocarbon and wherein said bulb contains a mixture of a gas comprising an aliphatic ether, lower aliphatic tertiary amine or lower aliphatic ketone, and an absorbent comprising an alkylene glycol, alcohol, glycol ether, polyether, ester, polyester, polyalcohol, polyamine, amide or polyamide.

51. The refrigeration apparatus of claim 32 having a cooling capacity of 1,000 watts or less.

52. The refrigeration apparatus of claim 32 having a cooling capacity of 500 watts or less.

53. The refrigeration apparatus of claim 32 having a cooling capacity of 250 watts or less.

54. The refrigeration apparatus of claim 32 having a cooling capacity of 100 watts or less.

55. The refrigeration apparatus of claim 32 wherein the effective flow area of said inlet port is at least 4 times larger than the effective flow area of said outlet port.

56. The refrigeration apparatus of claim 32 wherein the effective flow area of said inlet port is at least 10 times larger than the effective flow area of said outlet port.

57. The refrigeration apparatus of claim 32 comprising refrigerant flows of less than 12 kilograms per hour.

58. The refrigeration apparatus of claim 32 comprising refrigerant flows of less than 6 kilograms per hour.

59. The refrigeration apparatus of claim 32 comprising refrigerant flows of less than 3 kilograms per hour.

60. The refrigeration apparatus of claim 32 comprising refrigerant flows of between about 5 and about 75 grams per hour.

61. The refrigerant apparatus of claim 34 wherein response time of pressure decay in said valve cavity following closing of said inlet port is shorter than bulb pressure response time following addition of refrigerant to said evaporator.

62. The refrigeration apparatus of claim 61 wherein the pressure decay response time is less than ⅓ of the bulb pressure response time.

63. The refrigeration apparatus of claim 32 wherein said valve cavity has a volume less than the volume of said evaporator.

64. A method of operating the refrigeration apparatus of claim 32 comprising supplying refrigerant from said valve assembly to said evaporator at the rate of less than 12 kg/hr and pulsing said valve assembly between open and closed during the operation.

65. The method of claim 64 wherein the flow rate of said refrigerant from said valve assembly is less than 6 kg/hr.

66. The method of claim 64 wherein the flow rate of said refrigerant from said valve assembly is less than 3 kg/hr.

67. The method of claim 64 wherein the flow rate of said refrigerant from said valve assembly is between about 5 and about 75 grams/hr.

* * * * *